US005860250A

United States Patent [19]

Hill et al.

[11] Patent Number: 5,860,250

[45] Date of Patent: Jan. 19, 1999

[54] GATE DEVICE

[76] Inventors: Kathy E. Hill, 195 Robinwood Pl.; James I. Bowman, 517 Fourth St., both of Danville, Va. 24540

[21] Appl. No.: 720,437

[22] Filed: Sep. 30, 1996

[51] Int. Cl.[6] ..... E05D 7/00

[52] U.S. Cl. ..... 49/397; 49/55; 49/372

[58] Field of Search ..... 49/50, 55, 57, 49/372, 374, 378, 381, 399, 397; 40/538; 16/225, 230, 231

[56] References Cited

U.S. PATENT DOCUMENTS

| | | | |
|---|---|---|---|
| D. 47,472 | 6/1915 | Quackenbush . | |
| 453,627 | 6/1891 | Draper . | |
| 695,666 | 3/1902 | Bommer . | |
| 2,490,612 | 12/1949 | Ballard . | |
| 2,581,857 | 1/1952 | Harrison . | |
| 2,833,248 | 5/1958 | Meyer et al. . | |
| 2,851,746 | 9/1958 | McPhaden . | |
| 2,855,037 | 10/1958 | Stiffel . | |
| 2,894,295 | 7/1959 | Singleton | 49/397 X |
| 2,950,836 | 8/1960 | Murdock . | |
| 3,064,305 | 11/1962 | Hill . | |
| 3,351,311 | 11/1967 | Melfi . | |
| 3,633,316 | 1/1972 | Belser | 16/225 X |
| 3,885,616 | 5/1975 | Berkowitz . | |
| 4,438,605 | 3/1984 | DeLucia | 16/225 X |
| 4,583,715 | 4/1986 | Wright . | |
| 4,669,521 | 6/1987 | Barnes et al. . | |
| 4,671,012 | 6/1987 | Merklinger et al. . | |
| 4,702,036 | 10/1987 | Johnson . | |
| 4,777,765 | 10/1988 | Johnson, Jr. . | |
| 4,903,929 | 2/1990 | Hoffman . | |
| 5,199,753 | 4/1993 | Presley, Jr. . | |
| 5,241,789 | 9/1993 | Vacelet . | |
| 5,265,848 | 11/1993 | Michaud et al. | 256/26 |
| 5,272,840 | 12/1993 | Knoedler et al. . | |
| 5,360,191 | 11/1994 | Carson et al. . | |
| 5,367,829 | 11/1994 | Crossley et al. . | |
| 5,437,115 | 8/1995 | Freese et al. . | |
| 5,442,881 | 8/1995 | Asbach et al. . | |
| 5,457,914 | 10/1995 | Johnson et al. . | |

FOREIGN PATENT DOCUMENTS

| | | | |
|---|---|---|---|
| 212089 | 5/1957 | Australia . | |
| 3514765 | 10/1986 | Germany | 16/225 |
| 2 129 473 | 5/1984 | United Kingdom . | |
| 28074 | 10/1987 | United Kingdom | 40/538 |

*Primary Examiner*—Jerry Redman
*Attorney, Agent, or Firm*—Fisher, Christen & Sabol

[57] ABSTRACT

A fully adjustable gate device has a gate panel that may be a two-dimensional or three-dimensional cartoon character or animal to provide an attractive diversion for the confined child. The hinge member and latch member are attachable to the vertical surfaces of either side of a door opening by a C-shaped device, which provides secure fastening force, while not requiring marking with permanent holes or disfiguring the vertical surfaces. The gate panel may be telescoping to accommodate openings of various widths and the C-clamp hinge and latch may be adjustable to accommodate walls or other vertical surfaces having different depths or thicknesses. A compression-activated tong-shaped latch device is engaged and disengaged from the latch member by applying pressure and sliding the telescoping gate to the side, which permits the gate panel to swing freely in either direction.

19 Claims, 9 Drawing Sheets

GATE DEVICE

FIELD OF THE INVENTION

This invention relates to a gate device for attachment across an opening defined by a pair of opposed, vertical surfaces.

BACKGROUND OF THE INVENTION

In environments where small children, infants or pets are present, it is desirable and advantageous to have a gate or closure device which may be temporarily placed within a doorway to prevent passage through the opening. For example, it may be desirable to restrict small children to a particular room without shutting the door to the room such that one can look into the room or the children can see an adult nearby. It is also desirable and advantageous to have a gate or closure device that is visually appealing so that a child does not focus on being restricted to a specific area of the home, but instead is comforted or entertained by the device.

Various gate devices have been proposed wherein the gate may be removably mounted within a doorway and which typically include means for adjusting the width of the gate to accommodate different doorway widths. U.S. Pat. No. 2,490,612 to Ballard and U.S. Pat. No. 2,581,857 to Harrison disclose gate devices capable of accommodating openings of varying widths, and are located in the opening by the use of U-shaped devices on either side of the gate which straddle the door jambs. These devices must be either removed or stepped over in order to enter or exit the opening, for example, in the event an adult has to attend to or check on a small child.

U.S. Pat. No. 5,457,914 to Johnson, Jr., U.S. Pat. No. 5,437,115 to Freese, et al., U.S. Pat. No. 5,367,829 to Crossley, et al., U.S. Pat. No. 5,360,191 to Carson, et al., U.S. Pat. No. 2,851,746 to McPhaden and Australian Patent Specification No. 212089 all disclose gate devices which are extendible to span openings of varying widths. These devices are held in the door opening or passageway by placing the gate device in compression, thereby applying outward pressure against the door jambs or passageway walls to hold the device in the opening, usually by the use of soft bumpers or pads which frictionally engage the side of the opening. These gate devices also need to be stepped over or removed in order to enter or exit the opening. Alternately, the gate device disclosed in U.S. Pat. No. 5,367,829 to Crossley, et al. may be permanently hinged in the opening. This requires drilling holes in the side of the opening, for example, the door jamb.

U.S. Pat. No. 4,702,036 to Johnson discloses a safety gate device which uses two individual segments, overlapping in the center of the opening, to span openings of various widths. The hinges are permanently attached to each side of the opening.

British Patent Publication GB 2129473A discloses a hinged, adjustable gate device with an adjustable tubular frame to fit various width openings. The hinge is permanently attached to one side of the door opening.

U.S. Pat. Nos. 5,272,840 to Knoedler et al., 5,442,881 to Asbach et al., and 4,583,715 to Wright disclose gate devices which have hinged frames so that the opening may be entered without stepping over or removing the gate. However, the integral L- or U-shaped frame must be stepped over when one passes through the opened gate. The frames of these gate devices are held in place in the opening by an outward lateral force which is applied to the doorway opening sides via pads on the outer portions of the frames which frictionally engage the door opening.

If a frictionally engaged gate device is improperly adjusted, or if the opening has an irregular surface or is not plumb, it may be possible to disengage such frictionally engaged gates by applying sufficient force to the gate frame to displace it from the opening. A small child, if determined, may be capable of applying such a force. If an excessive amount of force is used to keep the gate in place, the door opening may be damaged or marred.

U.S. Pat. No. 4,777,765 to Johnson Jr. discloses an adjustable width, hinged safety gate apparatus which may be fastened to the door frame pillar with a clamp-on unit having an integral hinge.

Many proposed gate devices such as those of U.S. Pat. No. 3,064,305 to Hill, U.S. Pat. No. 3,885,616 to Berkowitz and U.S. Pat. No. 4,669,521 to Barnes et al. utilize an expandable accordion type closure device. Although newer designs provide features to prevent head and neck entrapment, such accordion devices still provide the opportunity for capturing fingers, toes or other body parts.

Other devices have been proposed to mount doors or other devices in openings. U.S. Pat. Nos. 453,627 to Draper and 695,666 to Bommer disclose adjustable spring hinges for mounting lavatory doors onto marble slabs. These devices require the use of bolts drilled through the marble slab to attach the adjustable spring hinge to the marble slab. U.S. Pat. No. 2,833,248 to Meyer et al. discloses a livestock holder with a swinging gate attached to a frame which is held in an opening by U-shaped devices on the bottom, straddling the doorsill, and screw clamp type devices on the top, to attach to the door opening.

Many of the presently proposed gate devices incorporate a mesh or grid type design for major portions of the gate panels spanning the opening which, although functional, provide no visual diversion for a small child or infant while retained inside a room. The appearance of these gate devices does not contribute towards the child's acceptance of their confinement within a room or space and the limitation on their movement. The outward appearance of the various proposed gate devices is that of a barrier, which may be considered as ominous and threatening to the child, and possibly interpreted by the child as conveying a message of separation and alienation from others within the household. U.S. Design Patent No. D47472 to Quackenbush discloses an ornamental design for childrens' fence gates which has small illustrations of nursery-rhyme characters such as Humpty-Dumpty and the like on a gate for a fence. The design patent does not disclose a gate at least partially in the shape of a cartoon character or animal.

The present invention provides a gate device for use in a door opening having two opposed vertical surfaces. The gate device may be at least partially in the form of a two-dimensional or three-dimensional cartoon character or animal and provides an aesthetically pleasing device for confining a small child in desired space without conveying a message of separation to the small child. The gate device provides for secure attachment to both sides of the door opening without the necessity for permanently affixing the gate device. The gate device of the present invention may be used in openings of various widths and also for vertical surfaces having different depths, such as, walls, banister posts and the like.

SUMMARY OF THE INVENTION

The present invention provides a gate device for use in an opening defined by opposing first and second vertical surfaces such as door jambs, banister posts, hallway openings and the like. The gate device of the present invention comprises a hinge member attached to a vertical surface and a latch device attached to the opposing vertical surface and a gate panel member pivotally mounted to the hinge which may be at least partially in the shape of a cartoon character or animal. Utilizing a familiar cartoon character or the friendly face of an animal can divert the child's confinement focus to thoughts that are pleasant and entertaining. Also, an animal or cartoon character can be used to enhance and coordinate with the existing decor of the room or space that the gate device is used in.

The gate device of the present invention may have a gate panel member which is adjustable for use in openings having various widths. The gate device of the present invention is also adjustable for use in door openings having vertical surfaces of various depths. The gate device of the present invention may be used in openings having vertical surfaces on either side of the opening which may have having different depths from one side to the other, or moved to a second opening that has vertical surfaces with a different depth than the first opening. Vertical surfaces may be, for example, walls, banister posts and the like. As referred to herein, width of the opening refers to the distance from one side of the opening to the other, measured horizontally, and in the same plane or a plane parallel to the opening, wherein width is defined as being the distance between opposing first and second vertical surfaces.

The gate panel member also may comprise a first panel member which is pivotally mounted the hinge member and a second panel member which is slidably mounted on the first panel member. This second panel member may be at least partially in the shape of a cartoon character or animal. The second panel member may comprise a front panel and a rear panel which are positioned opposite each other and form a cavity in which the first panel member is at least partially located. Either or both of the front and rear panels of the second panel member may be at least partially in the shape of a cartoon character or animal to contribute toward the child's acceptance of their confinement, and diminish the threatening aspect of a cage-like gate which conveys a message of separation and alienation to the child.

The gate device of the present invention may be constructed of any suitable material, such as wood or plastic. Preferably, all of the components of the gate device of the invention may be constructed from a lightweight, molded durable plastic, which prevents the growth or harboring of bacteria and germs which may occur when a child and/or animal chews on a gate made from soft and/or porous material. Use of a durable material also prevents the unsightly tooth marks which may be present when softer materials are chewed. The use of a lightweight material, along with the unique design of the gate device of the present invention, makes the gate device easy to handle, install and remove.

The gate panel member also may be at least partially in the shape of a three-dimensional cartoon character or animal.

In a preferred embodiment of the invention, the hinge comprises a mounting plate with a hinge pin receptacle having a hollow slotted cavity for receiving a hinge pin. In another preferred embodiment of the invention, the sides of the continuous slot of the hinge pin receptacle limit the pivotal movement of the gate panel.

In a preferred embodiment of the invention, the gate panel is adjustable and telescoping and comprises a first panel member pivotally mounted to the hinge and positioned at least partially inside a second panel member, which is slidably mounted on the first panel. In other preferred embodiments of the invention, the latch for securing the gate panel member to the vertical surface on the side of the door opening comprises a receiving member and a compressible insertion member. The operation of the latch is accomplished by compressing the insertion member and moving the second panel member a sufficient distance to either engage or disengage the insertion member and the receiving member. Once the second panel member and the insertion member are disengaged from the receiving member, the gate panel may be swung freely.

In a preferred embodiment of the invention, the hinge member and latch mounting panel are specially configured C-shaped devices which may attach to the vertical surfaces of a door opening which already has a hinged door attached therein. The shape and configuration of the C-shaped hinge member and latch mounting panel does not prevent substantial pivotal movement of the door with the gate device of the invention attached in the door opening.

DETAILED DESCRIPTION OF THE INVENTION

The gate device of the present invention may be used to securely block or partition an opening such as a doorway, hallway, stairway opening, etc. Entry or exit of small children, infants or animals is prevented in an aesthetically pleasing manner, which limits the child's focus on confinement and presents a diversion. The gate device may be adjusted to openings of various widths, and may be provided in various heights in order to prevent a child from climbing over the gate. The gate device of the invention may be securely attached to both sides of the opening without the requirement of screw holes or the like. The gate device may be used in a door opening with a hinged door, while not preventing substantial pivotal movement of the installed door. The hinge member and latching member may be adjusted to fit vertical surfaces having different depths, such as, for example, thick walls or thin banister posts, or a combination of thin and thick vertical surfaces defining the opening. The gate device of the present invention may be latched by simply compressing a portion of the latch and sliding the telescoping gate panel slightly to the side to permit the gate to swing freely in either direction.

The flush fit between the gate panel and the hinge portion and the latch portion prevents the possibility of bodily injury to small parts of a child's body, for example, hands, fingers, feet, toes, etc.

As referred to herein, width of the opening refers to the distance from one side of the opening to the other, measured horizontally, and in the same plane or a plane parallel to the opening.

As referred to herein, depth of the vertical surface on each side of the opening refers to the dimension of the wall, bannister post or the like, measured horizontally and in a plane perpendicular to the plane that width is measured in. For example, a standard wall depth for walls framed with 2"×4" lumber would be a little less than 6", using ½" sheetrock for the wall surfaces and ½" moldings on either side of the doorjamb.

Figure 1:
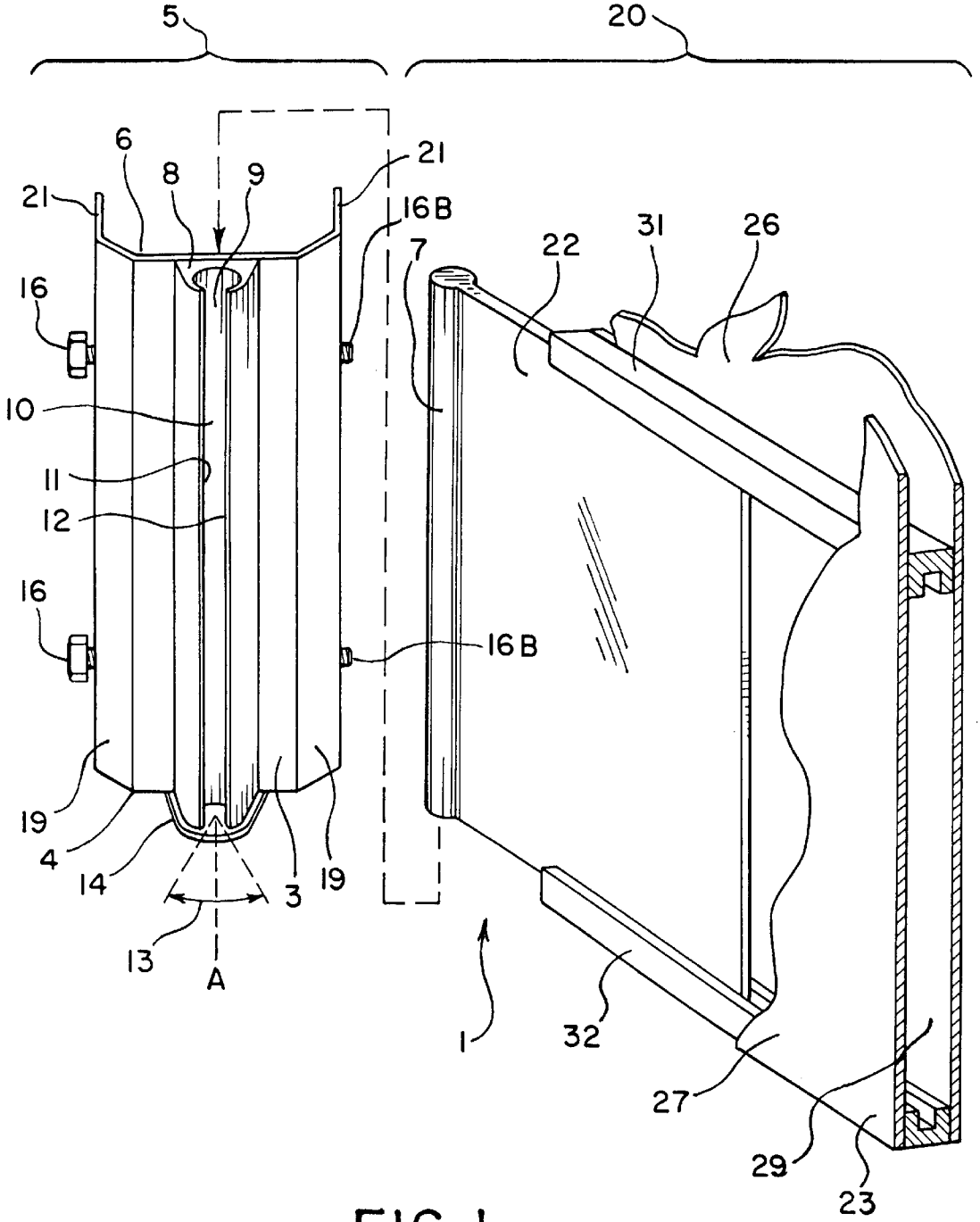
FIG. 1 is a partially exploded perspective view of embodiments of the hinge member and gate panel member in accordance with the present invention, having a portion of the gate panel member shown in cut-away.
Figure 2:
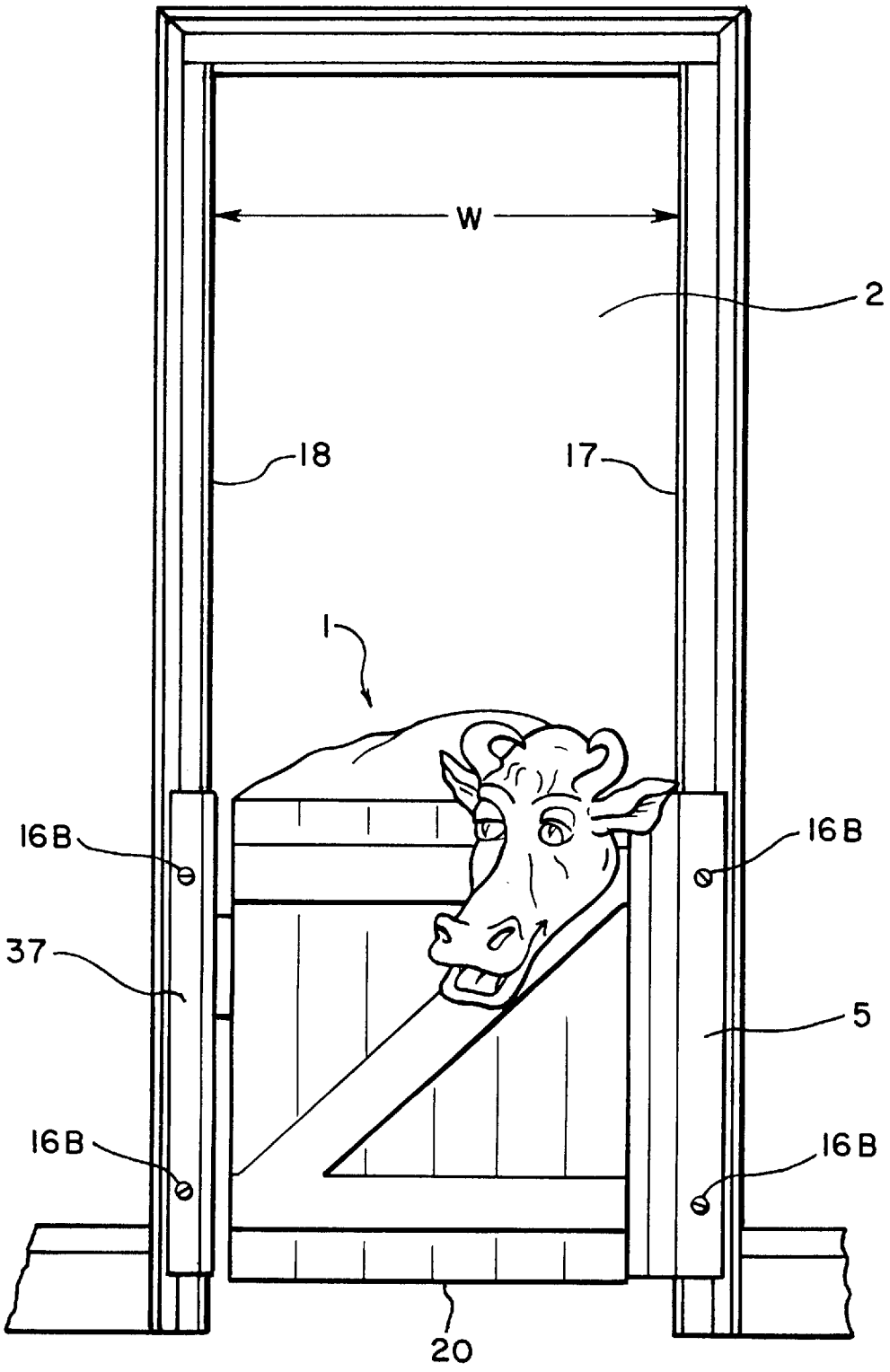
FIG. 2 is a schematic side view of an embodiment of the gate device in accordance with the present invention as viewed from within a child's room.

As shown in FIGS. 1, 2, 3 and 4, the gate device 1 for use in an opening 2 defined by opposing first vertical surface 17 and second vertical surface 18 in accordance with the present invention comprises a hinge member 5 attached to the first vertical surface 17, a gate panel member 20 pivotally mounted to the hinge member 5 and a latching portion 37 for securing the gate panel member 20 to the second vertical surface 18. As shown in FIG. 2, in embodiments of the invention, the gate panel member may be at least partially in the shape of a cartoon character or an animal. Also, as shown in FIG. 2, the gate panel member 20 may incorporate a design, such as the barnyard motif shown or other designs, such as a castle, a house, a fairytale motif, or any other design suitable to keep a small child contained in the desired space without the child having a feeling of confinement, as with standard child gates which have gate panels in the form of cage or mesh-like materials. In embodiments of the invention, gate panel member 20 may also be at least partially in the shape of a three-dimensional cartoon character or animal, and also other portions of the gate panel member 20 may be in a three-dimensional form, for example, a barnyard fence (as shown in FIG. 2) or a texture resembling brick or stone or any other material suitable to entertain and interest the child while contained in the desired space.

As shown in FIG. 1, gate panel member 20 may be adjusted for use in openings having various widths, the width W of the opening being defined as the distance between opposing first and second vertical surfaces 17 and 18 as shown in FIG. 2. As shown in FIG. 1, in embodiments of the invention, gate panel member 20 may comprise a first panel member 22 pivotally mounted (as shown by the dotted line and allow connecting hinge pin 7 and hinge pin receptacle cavity 9) to hinge member 5. Gate panel member 20 may also comprise second panel member 23 having a front panel 26 and a rear panel 27 positioned opposite each other and forming a cavity 29. The first panel member 22 is at least partially located within the cavity 29. Depending on the width W of the opening that the gate device 1 of the invention is to be used in, first panel member 22 may be positioned entirely within cavity 29 of second panel member 23. When the opening is substantially wider than second panel member 23, first panel member 22 may be slidably mounted in upper channel 31 and lower channel 32 and may be moved by sliding to the desired width of the opening. The range of width adjustment, or movement, of second panel member 23 may be up to about 20", or preferably up to about 15".

Figure 5:
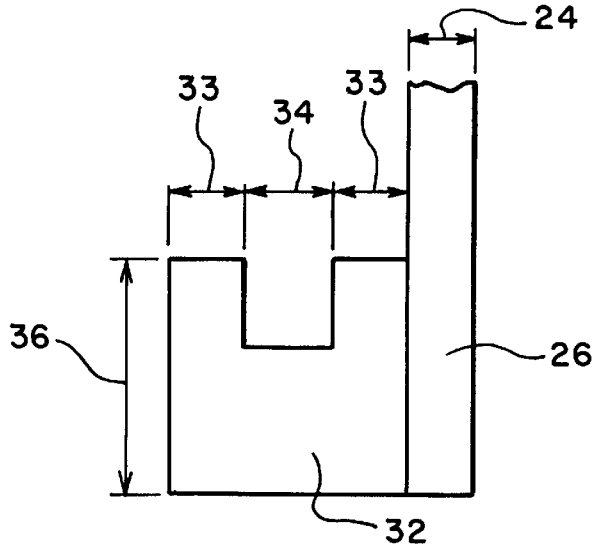
FIG. 5 is a schematic end view of a portion of the gate panel in accordance with the present invention.

As shown in FIG. 1, upper and lower channels 31 and 32 may extend to the full width of second panel member 23. Alternately, upper channel 31 and lower channel 32 may be less than the width of second panel member 23, preferably from about 12 inches to about 18 inches, more preferably upper and lower channels 31 and 32 may be about 15 inches in width. As shown in FIG. 5, for lower channel 32, which may be dimensionally the same as upper channel 31, shoulder width 33 may be from about ¼ inch to about ¾ inch, preferably, about ⅜ of an inch to about ½ inch, more preferably about 7/16 of an inch. Channel width 34 may be from about ¼ inch to about ¾ inch, depending upon the dimensions of first panel member 22, and more preferably may be about ½ inch. Channel height 36 may be from about 1 inch to about 2 inches, preferably from about 1¼ inch to about 1¾ inch, more preferably about 1⅜ inches. Front panel thickness 24 may be from about ¼ inch to about ½ inch, preferably about ⅜ inch. The thickness of rear panel 27 may be the same or different than the front panel thickness 24.

Referring to FIG. 1, gate panel member 20 may have only a front panel member 26, or optionally may include rear panel 27. Either or both of front panel 26 and rear panel 27 may be at least partially in the shape of a cartoon character or an animal in two-dimensional or three-dimensional form.

Figure 3:
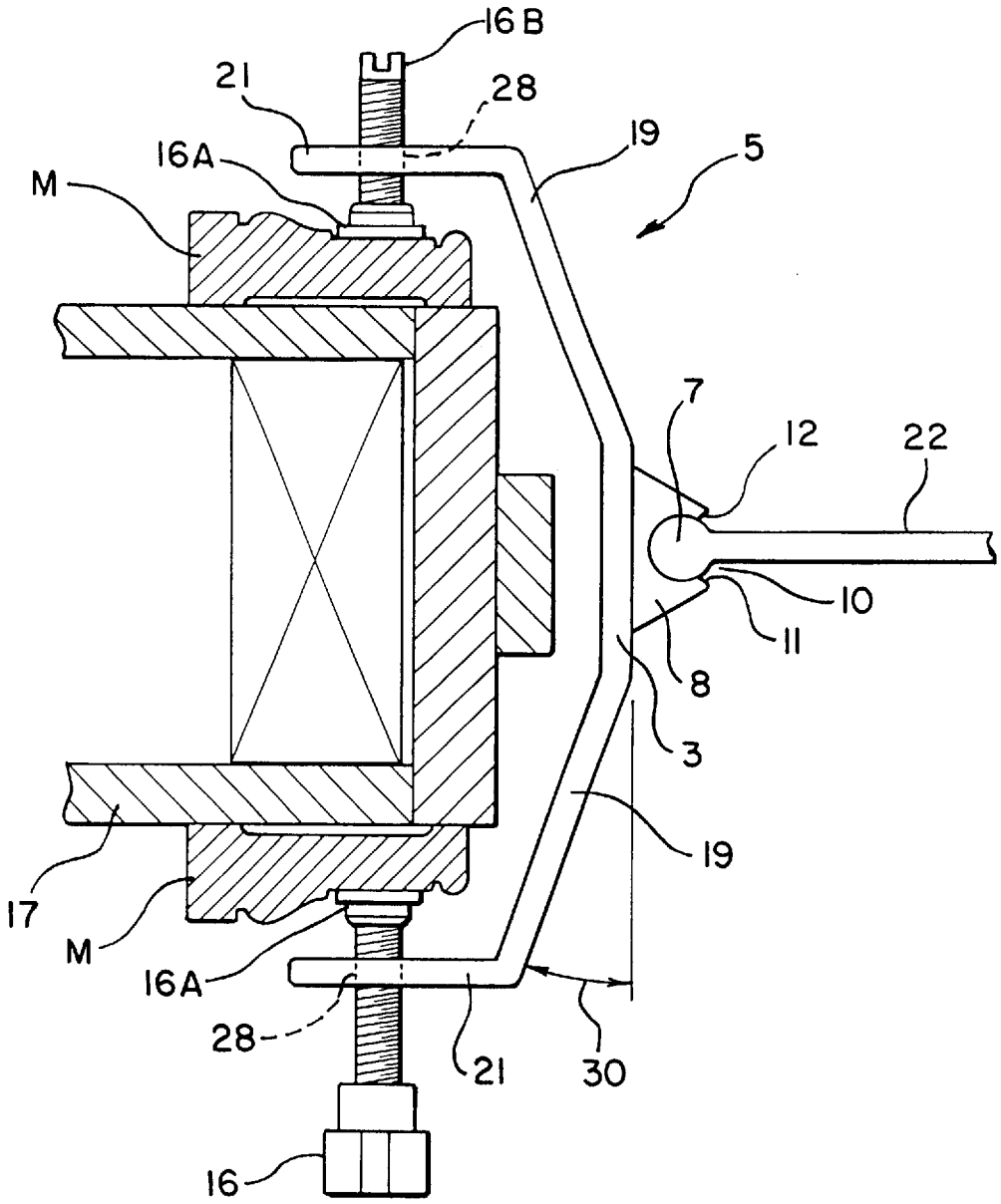
FIG. 3 is a schematic top view of the hinge member in accordance with the present invention, shown attached to a vertical surface.

As shown in FIGS. 1 and 3, hinge member 5 comprises a mounting plate 3 on which hinge pin receptacle 8 is mounted. Hinge pin receptacle 8 comprises a hinge pin receptacle cavity 9 for receiving a hinge pin 7 which is attached to first panel member 22. Hinge pin receptacle continuous opening or slot 10 is located opposite mounting plate 3, and comprises integral door stop surfaces 11 and 12. Integral door stop surfaces 11 and 12 contact that portion of first panel member 22 that abuts hinge pin 7 on both sides of door panel 22, depending on the direction that gate panel member 20 is displaced in. Thus, gate swing angle 13 shown in FIG. 1, which is defined by integral door stop surfaces 11 and 12, sets the range of movement possible for gate panel member 20. In embodiments of the invention, gate swing angle 13 may be from about 45° to about 150°. Door swing angle 13 may be centered or bisected by a line in the central, vertical plane of the opening or slot 10, as represented by dotted line A in FIG. 1. Alternately, door swing angle 13 may be displaced in either the forward or rearward direction by locating integral door stop surfaces 11 and 12 at points which are not equidistant from central axis A.

Hinge member 5 also comprises hinge member bottom 4 and hinge member top 6, the distance between which may be from about 18 inches to about 36 inches, depending on the height desired for gate panel member 20. More preferably, the height of hinge member 5 may be about 20 inches to about 24 inches, most preferably about 22 inches.

Hinge member 5 and latch mounting panel 35 may also each comprise tension knobs 16 for securely fastening hinge member 5 and latch mounting panel 35 to first and second vertical surfaces 17 and 18, respectively.

Each tension knob 16 may terminate in a removable swivel head 16A. Swivel head 1 6A may have a soft compliant material, such as, rubber or felt, at the point of contact with a vertical surface to prevent marring and to more securely fasten the hinge member 5 or latch mounting panel 35 to the vertical surfaces. Tension knobs 16 are threaded and are received in threaded holes 28 in either the hinge member 5 or the latch mounting panel 35 to apply the securing force. Preferably, two tension knobs 16 are located on either side of hinge member 5 or latch mounting panel 35 to securely fasten them to a vertical surface. However, depending on the particular configuration, more or less than two tension knobs may be used for either hinge member 5 or latch mounting panel 35.

In preferred embodiments, the tension knobs 16 are located only on the side of the hinge member 5 and only on the side of the latch mounting panel 35 which is external to or faces the outside of the room in which the child is confined so that the child cannot reach or turn the knobs to remove the gate 1. However, it is preferable to include a plurality of threaded holes 28 on both sides of the hinge member 5 and both sides of the latch mounting panel 35 for receiving the tension knobs 16. In this embodiment, the gate may be assembled so that the knobs are on the outside of the room whether the hinge member 5 is attached to either side of the doorjamb, or either of vertical surfaces 17 and 18. For example, doorways with left hinged doors or right hinged doors may be accommodated by switching the tension knobs 16 from the holes 28 on one side of the hinge member 5 to the holes 28 on the other side of hinge member 5.

In embodiments of the invention, the threaded holes 28 on the interior side of the hinge member 5 and latch mounting panel 35 may receive rubber or plastic plugs or "child-resistant" tensioning bolts 16B which cannot be readily loosened or removed by a child. For example, the tensioning bolts 16B may have a slot at their terminus for tensioning or loosening with a screw driver or they may have a hexagonal head for tensioning or removal with a wrench. The tensioning bolts 16B may also include a removable swivel head 16A for contacting the vertical surfaces 17, 18 of the doorway. The optional tensioning bolts 16B and the tensioning knobs 16A may be used to adjust the positions of or align the hinge member 5 and latch mounting panel 35 in a direction perpendicular to the vertical plane of the doorway.

In other embodiments of the invention, the threaded holes 28 on the interior side of the hinge member 5 and the interior side of the latch mounting panel 35 may be covered by a flexible or resilient sleeve (not shown). The sleeve may extend the length of the mounting plate 3 and may be adapted for receiving the end portion of mounting section 21. The soft compliant sleeve may be made of rubber or felt to conform to and prevent marrying of the vertical surfaces 16, 17.

The hinge member 5 and the latch mounting panel 35 may also be turned upside-down or flipped over to locate the knobs 16 outside of the room where the child is located. In this embodiment, the hinge member 5 may be provided with a removable, snap-on bottom-plate 14 which is snappingly engageable with each end 4 and 6 of hinge member 5.

Figure 4:
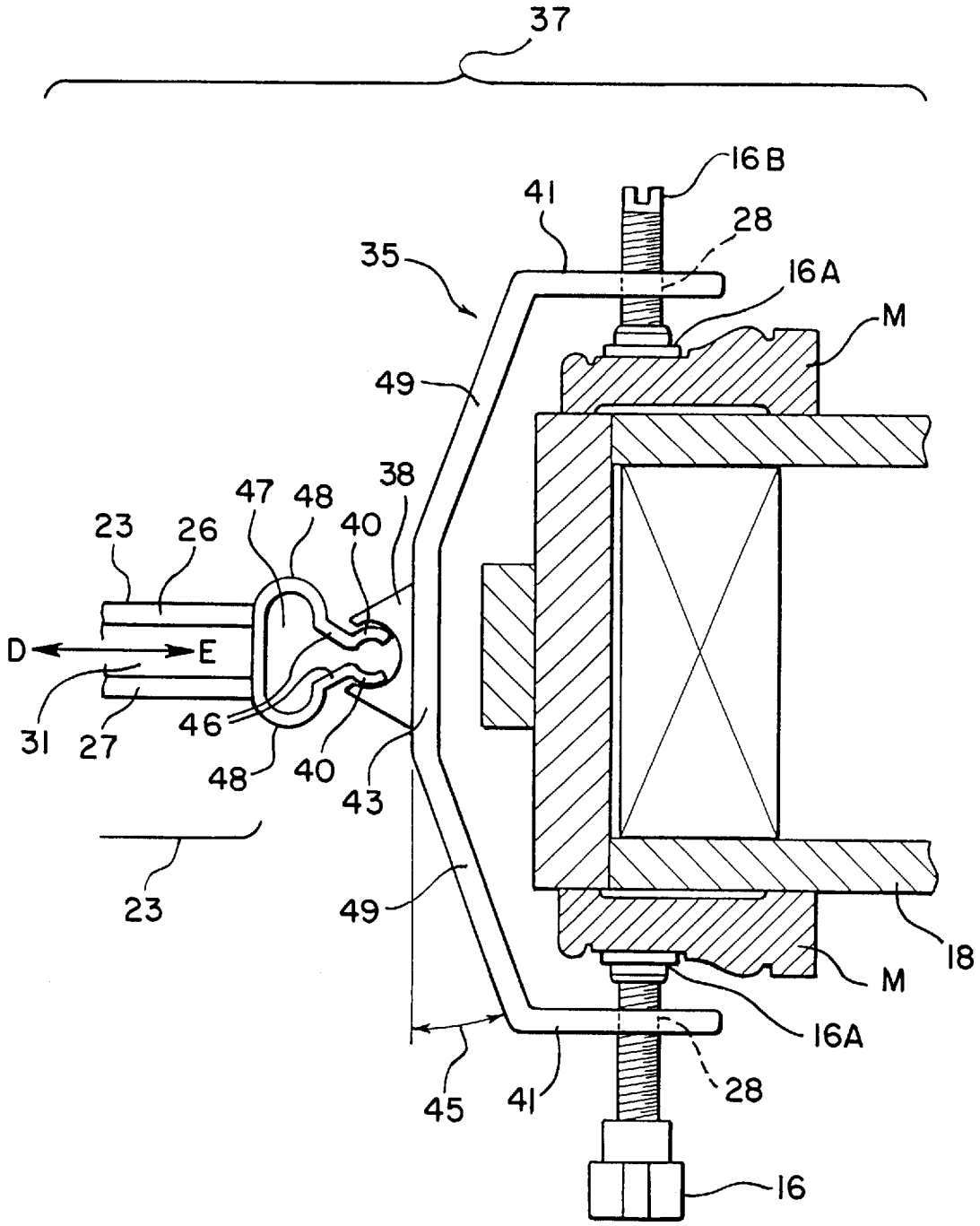
FIG. 4 is a top schematic view of the latching portion in accordance with the present invention, shown attached to a vertical surface.

As shown in FIGS. 3 and 4, swivel heads 16A are adaptable to apply a securing force to door jamb moldings M and to accommodate vertical surfaces having varied depths. Swivel heads 16A are adaptable to the various types of door moldings M that can be encountered in typical homes, and are adaptable to provide the securing force even when they are disposed at an angle due to the configuration of the door molding M. Swivel head 16A may be detached from tension knob 16 to permit installation and removal of tension knob 16. As shown in FIGS. 3 and 4, hinge member 5, and latch mounting panel 35 are "C-shaped", in order to span the vertical surfaces 17 and 18, respectively, and to enable tension knobs 16 to be placed on either side of the vertical surface (shown as a doorjamb in FIGS. 3 and 4) and to accommodate fastening to vertical surfaces of varied depth.

In a preferred embodiment, mounting plate 3 of hinge member 5 is connected to angled sections 19, which are connected to tension knob mounting sections 21 containing threaded holes 28. The angled sections 19 function to allow the installation of hinge member 5 on a door jamb having a hinged door in place. Also, angled sections 19 permit substantial pivotal movement of the door (not shown) on its hinges (also not shown), even when the hinge member 5 of the gate device 1 is in place on the doorjamb. Thus, the gate device of the invention permits partial closing of the permanently installed door to block out light, noise, etc. if the child is sleeping or taking a nap. Clearance angle 30 functions to enable the C-shaped hinge member 5 to allow pivotal movement of the installed door. The clearance angle 30 may preferably be from about 10° to about 35°, more preferably from about 20° to about 25°. Similarly, latch mounting panel 35 may comprise mounting plate 43, angled sections 49 and tension knob mounting sections 41. The angled sections 49 may be at a clearance angle 45 with the mounting plate 43 to permit latch mounting panel 35 to perform the same function of allowing substantial pivotal movement of the door in the event that the door is hinged on the side of the opening that latch mounting panel 35 is installed on. Clearance angle 45 may also preferably be from 10° to 35°, more preferably from 20° to 25°.

Figure 6:
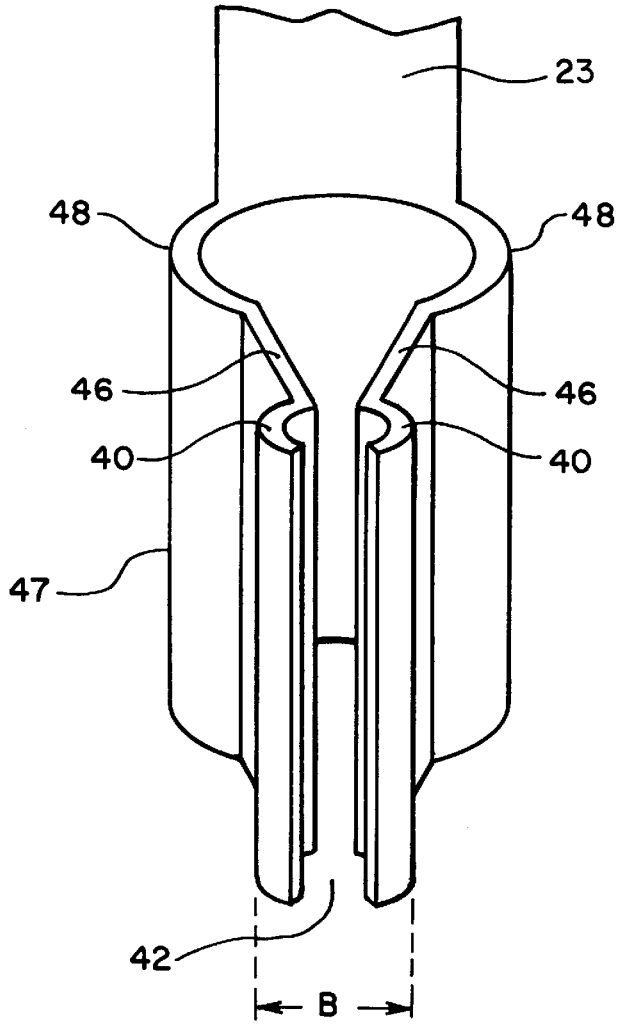
FIG. 6 is a perspective view of a compressible insertion member in accordance with the present invention.
Figure 7:
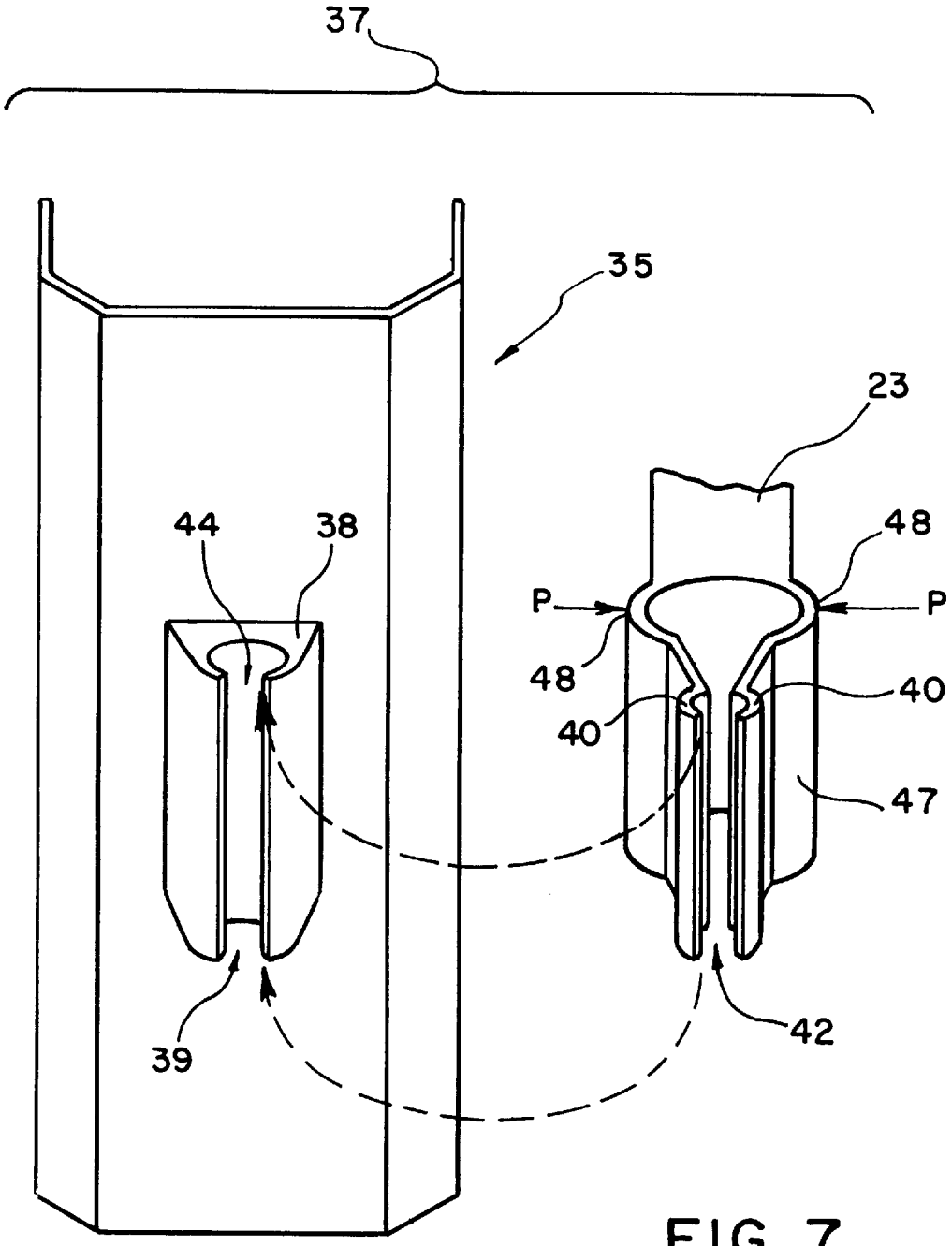
FIG. 7 is a partially exploded perspective view of a latching portion in accordance with the present invention.

As shown in FIGS. 4, 6 and 7, gate device 1 comprises latching portion 37 comprising latch mounting panel 35 for securing the second panel member 23 to the second vertical surface 18. Latch mounting panel 35 comprises a latch receiving member 3 8 for receiving a compressible latch insertion member 47. Latch insertion member 47 may be either mounted on or made an integral part of second panel member 23 of gate panel member 20. Latching and unlatching of gate device 1 may be accomplished by compressing the latch insertion member 47 and then moving second panel member 23 a sufficient distance to disengage or engage the latch insertion member 47 from latch receiving member 38.

In other embodiments of the invention, the latch insertion member 47 may be moved or slided independently of or relative to the movement of the second panel member 23 to engage or disengage the latch insertion member 47 and the latch receiving member 38. For example, the latch insertion member 23 may be attached to the second panel member 23 by means of a compressible spring (not shown) or telescoping or cylindrical extension rod (not shown) which extends into second panel member 23.

In a preferred embodiment, latch insertion member 47 is compressed at compression points 48 in the direction shown by the arrows P in FIG. 7. Compression of the "tong" type latch insertion member 47 at compression points 48 in the direction of the arrows P shown in FIG. 7 results in a transfer of the compressive force through connecting aims 46 to latch pin halves 40. This applied force causes latch pin halves 40 to move closer together, thus reducing latch pin gap 42. This movement of latch pin halves 40 together, which reduces latch pin gap 42, also reduces the distance B, the distance between the outermost portion of latch pin halves 40, as shown in FIG. 6. When the distance B is reduced a sufficient amount, latch insertion member 47 may be engaged or disengaged through latch receiving member opening 39 shown in FIG. 7. This is a result of the distance B becoming less than the dimension of latch receiving member opening 39, allowing the engaging or disengaging movement to occur without interference.

The amount of force required to compress compression points 48 may be sufficient to allow adults to operate the latch insertion member 47 with relative ease, while preventing infants or small children from operating the latch insertion member due to their insufficient grip strength. Latch receiving member 38 may have a cavity 44 disposed within it. Latch receiving member cavity 44 may be any shape able to accommodate latch pin halves 40 in a secure manner. Preferably, latch receiving member cavity 44 is vertically aligned and is in the shape of a cylinder. Latch receiving member 38 may be the same overall height as latch mounting panel 35, or may be substantially shorter than the overall height of latch mounting panel 35, as shown in FIG. 7.

Although it is not required, it is preferable to have the overall height of latch insertion member 47 and the overall height of latch receiving member 38, as well as their relative height from the floor, at least substantially the same. With the overall height of latch insertion member 47 and the overall height of latch receiving member 38, as well as their relative height from the floor being the same, latch insertion member 47 and latch receiving member 38, when in the latched position, will have their respective tops and bottoms in a flush fit. Also, the latch portion of the invention does not attract the attention of a small child, especially in the flush fit orientation, so that the child does not attempt to open the gate device.

As shown in FIG. 7, the top of latch receiving member 38 may be located a vertical distance down from the top of latch mounting panel 35. This distance that the top of latch receiving member 38 is located down from the top of latch mounting panel 35 may be from about ½ the total height of latch mounting panel 35 to about ⅓ of the total height, and is more preferably about ¼ of the total height of latch mounting panel 35. This distance down from the top of latch mounting panel 35 may also be from about 6" to about 10", more preferably about 8".

The curved dotted lines in FIG. 7 show the interrelationship between latch insertion member 47 and latch receiving member 38 when engaged, and are not meant to show the disengaged position of latch insertion member 47. FIG. 4 shows latch insertion member 47 and latch receiving member 38 in the engaged position, which occurs by an engaging movement in the direction of the right hand side E of the double arrow line DE. The disengaged position would be represented by moving latch insertion member 47 towards the left as shown by the left handed side D of double arrow line DE in FIG. 4. After latch insertion member 47 has been disengaged from latch receiving member 38, it may be swung freely in either direction, until first panel member 22 contacts either of integral door stop surfaces 11 or 12.

In embodiments of the invention, hinge pin 7, attached to first panel member 22, may be inserted into hinge pin receptacle cavity 9 as indicated by the dotted line in FIG. 1. Hinge pin 7 slides downward through hinge pin receptacle cavity 9 until it contacts bottom plate 14, upon which it rests and pivots. If desired, the top of hinge pin receptacle cavity 9 may be sealed off after the installation of hinge pin 7 in order to prevent removal and keep hinge pin receptacle cavity 9 free of debris and dirt, etc.

Figure 8:
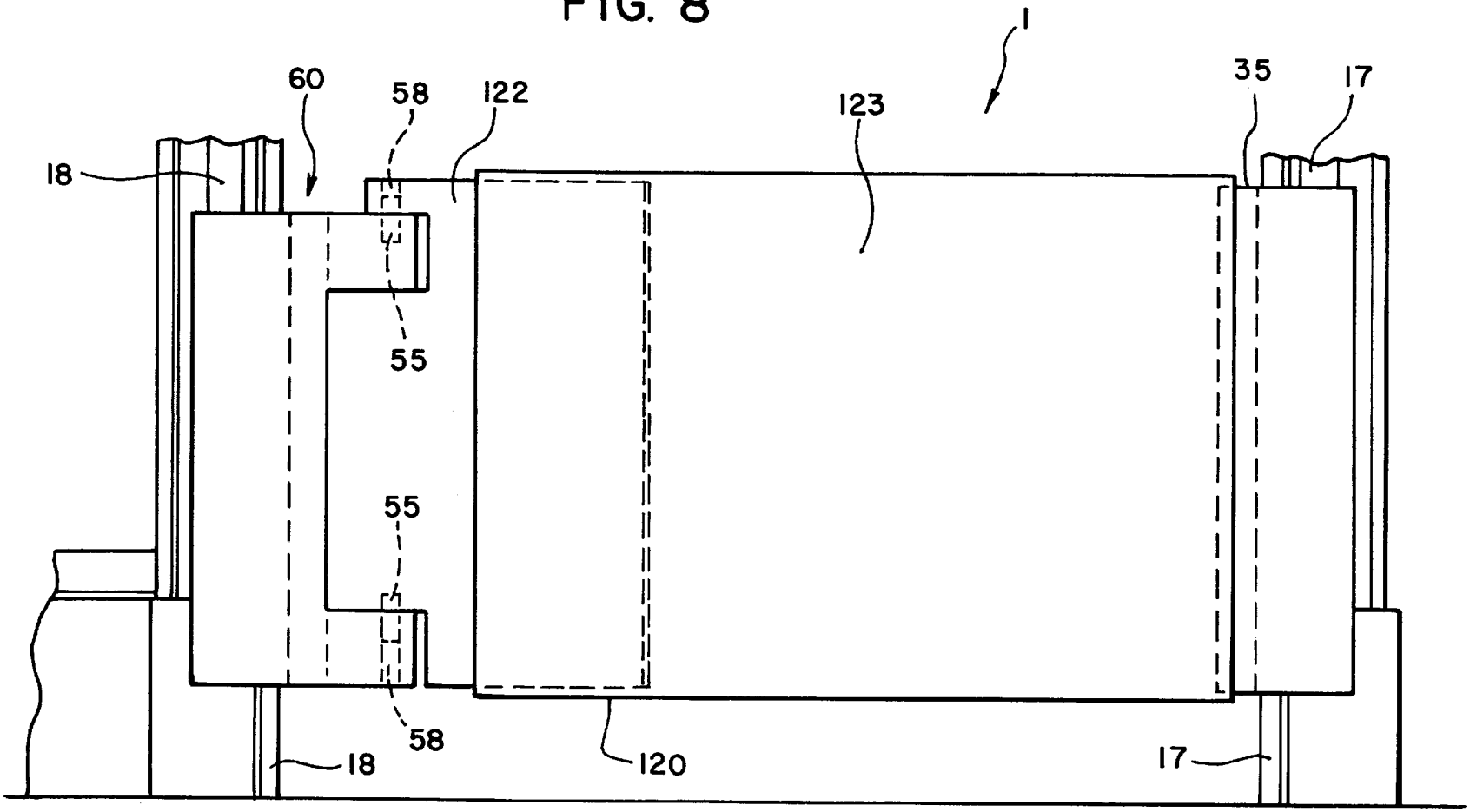
FIG. 8 is a side schematic view of another embodiment of a gate device in accordance with the present invention.
Figure 9:
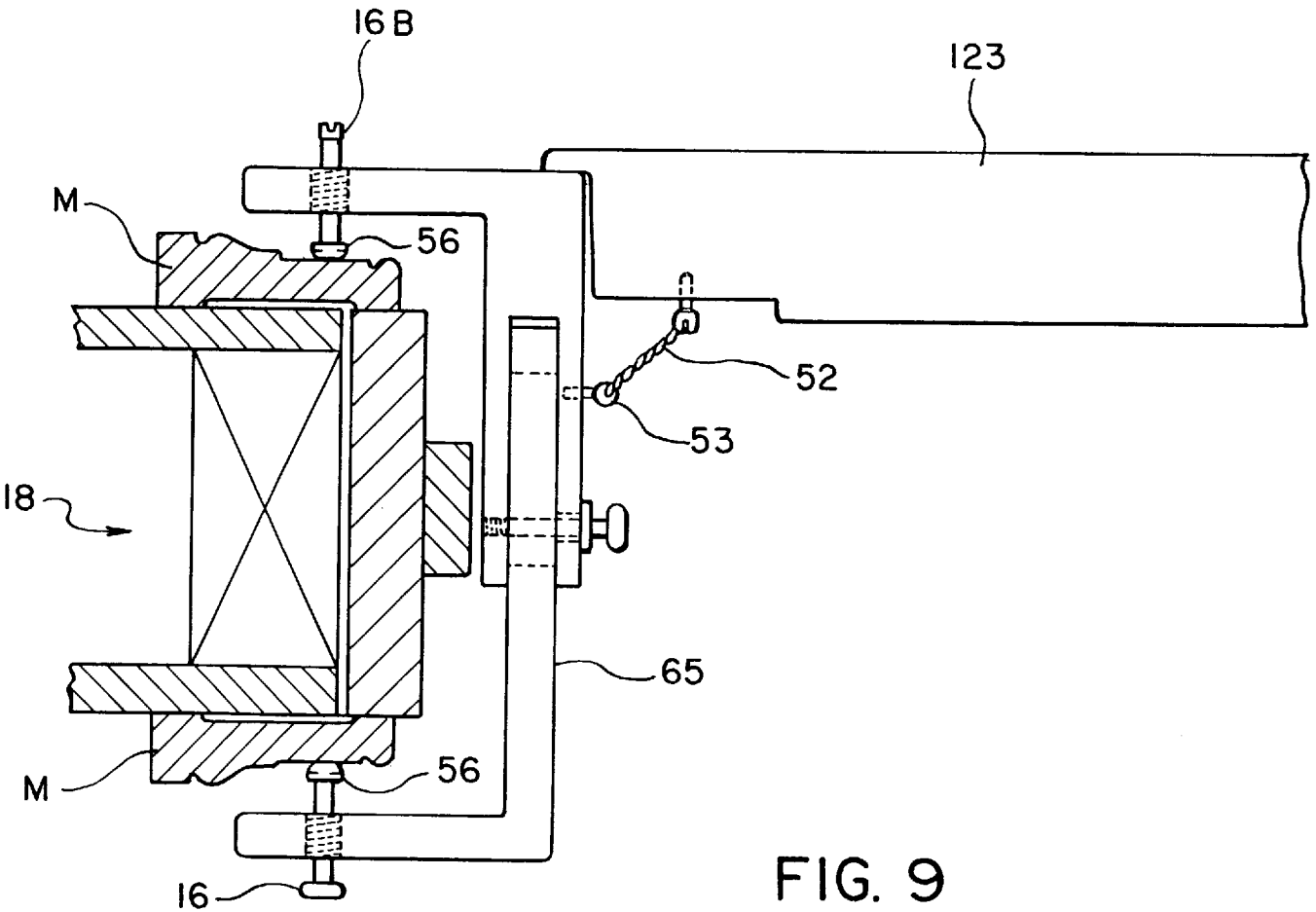
FIG. 9 is a top view of an embodiment of an adjustable latching portion of the gate device of FIG. 8 in accordance with the present invention, secured to a vertical surface.
Figure 10:
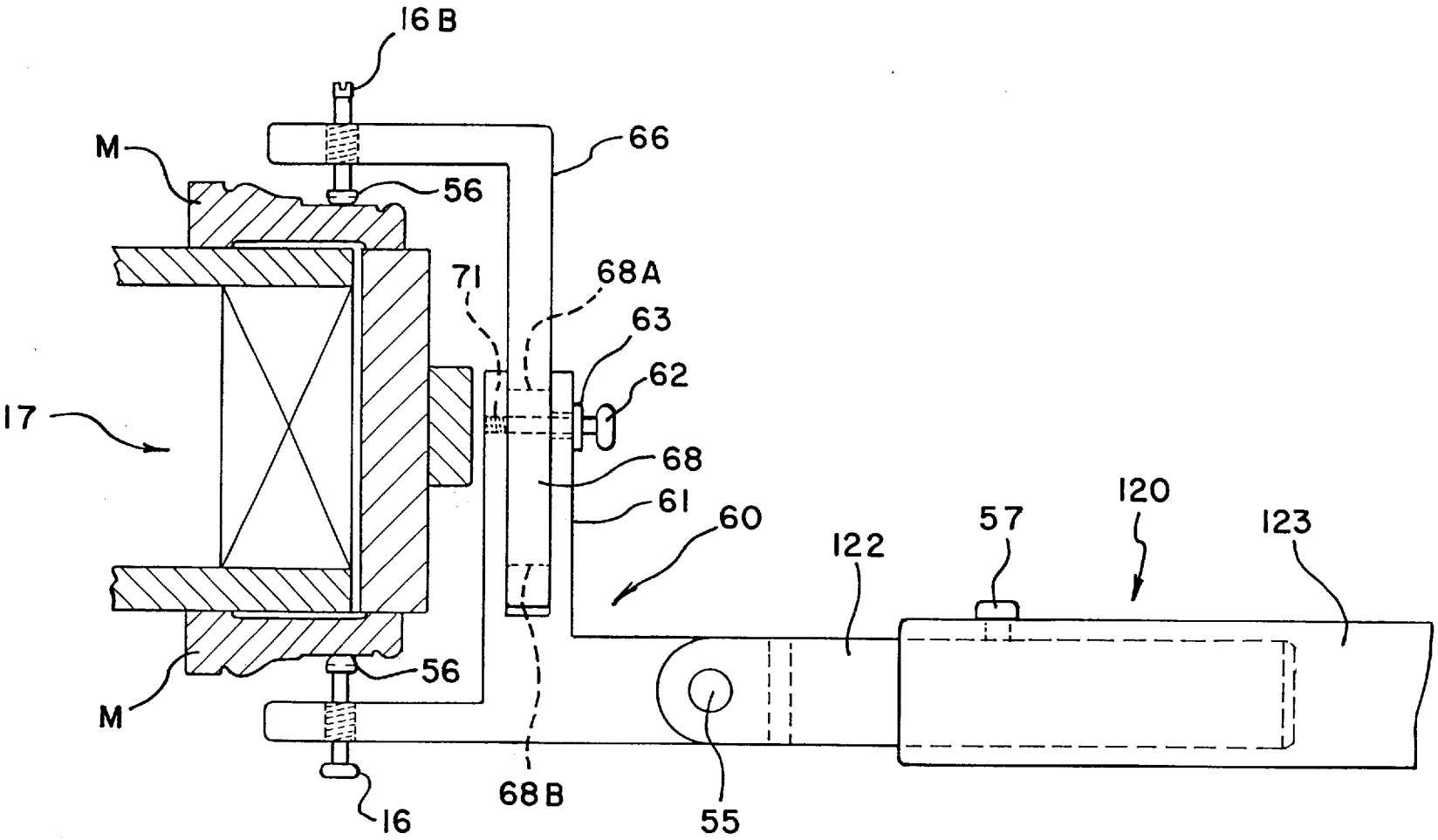
FIG. 10 is a top schematic view of an adjustable hinge member of the gate device of FIG. 8 in accordance with the present invention, secured to a vertical surface.

As an alternative to the removable hinge pin assembly shown in FIGS. 1, 3 and 4, in other embodiments of the invention a permanent hinge assembly may be used, as shown in the embodiment of FIGS. 8, 9, and 10. Adjustable hinge member 60 comprises hinge pins 55 securing first panel member 122 in a pivotal relationship with adjustable hinge member 60. Hinge pins 55 are securely installed through holes 58. Also shown in FIGS. 8 and 10 is an alternative embodiment of the telescoping gate panel 120 of the invention wherein first panel member 122 is slidably disposed within second panel member 123. When first panel member 122 and second panel member 123 are adjusted properly to fit the desired opening, set screw 57 is firmly tightened to hold first panel member 122 and second panel member 123 in their relative positions. The use of a fastening means to fix the relationship between first panel member 122 and second member 123, such as set screw 57, enables the use of a relatively simple latching device as shown in FIG. 9. This latching device may comprise a hook 52 and an eye 53, as shown in FIG. 9.

As shown in FIGS. 9 and 10, in embodiments of the invention, adjustable latch mounting panel 65 and adjustable hinge member 60 of the present invention are adapted to expand or reduce to accommodate vertical surfaces having varied depths, over and above the adjustment which may be provided by tension knobs 16. For example, it is common in the home to have a vertical surface with a dimension different from that of a standard wall thickness such as thin interior walls, thick exterior walls, bannister posts, etc. Different sides of the same opening may have different depths as well. In this case, the adjustable latch mounting panel 65 or adjustable hinge member 60 may be adjusted to fit the vertical surfaces having various thicknesses. The adjustment of the adjustable latch mounting panel 65 or adjustable hinge member 60 are the same and is described below for adjustable hinge member 60. As shown in FIG. 10, locking screw 62 has a fixed collar 63 which bears against the surface of adjustable hinge member receiving section 61. Adjustable hinge member insertion section 66 is received in a channel provided in adjustable hinge member receiving section 61. Adjustable hinge member insertion section 66 comprises a slot 68 having slot ends 68A and 68B which define the range of adjustment possible for adjustable hinge member 60. Locking screw 62 is positioned to go through slot 68 and into threaded hole 71. As locking screw 62 is tightened, collar 63 and the portion of adjustable hinge member receiving section 61 located near threaded hole 71 move together and apply compressive force on adjustable hinge member receiving section 66, thus locking adjustable hinge member receiving section 61 and adjustable hinge member insertion member 66 together in a fixed relationship. An identical configuration is shown in FIG. 9 adapted to adjustable latch mounting panel 65.

Also shown in FIGS. 9 and 10 are tension knobs 16 and 16B having integral hemispherical bearing surfaces 56 for attachment to first and second vertical surfaces 17 or 18. Integral hemispherical bearing surfaces 56 may be made from a soft or compliant material, such as, rubber or soft plastic in order to facilitate gripping first and second vertical surfaces 17 and 18.

In other embodiments of the invention, a compression type latch insertion member 47 and latch receiving member 38 may be combined with the C-clamp type adjustable latch mounting panel 65, and a slot-type hinge pin 7 and hinge pin receptacle cavity 9 may be combined with the adjustable hinge member 60, as a substitute for the latch and hinge arrangement shown in FIGS. 9 and 10.

What is claimed is:

1. A gate device for use in an opening defined by opposing first and second vertical surfaces, said gate device comprising:

(a) a hinge member for attachment to said first vertical surface, (b) a gate panel member having a length and pivotally mounted to said hinge and at least partially in a shape selected from the group consisting of a cartoon character and an animal, and (c) a latch for securing said gate panel member to said second vertical surface, wherein the length of said gate panel member is adjustable for use in openings having various widths, said gate panel member comprising a first panel member pivotally mounted to said hinge member and a second panel member slidably mounted on said first panel member wherein said second panel member is at least partially in said shape.

2. A gate device as claimed in claim 1 wherein said second panel member comprises a front panel and a rear panel positioned opposite each other and forming a cavity, said first panel member being located at least partially inside said cavity of said second panel member, and at least one of said front and rear panels is at least partially in said shape.

3. A gate device as claimed in claim 1 wherein said second panel member is at least partially in said shape and wherein said shape is 3-dimensional.

4. A gate device as claimed in claim 1 wherein said hinge comprises a mounting plate on which a hinge pin receptacle is mounted, said hinge pin receptacle comprising a cavity and a continuous slot opposite said mounting plate, said cavity receiving a hinge pin through said slot.

5. A gate device as claimed in claim 4 wherein said continuous slot limits pivotal movement of the gate panel member.

6. A gate device as claimed in claim 4 wherein said gate panel member comprises a hinge pin for pivotal mounting within said hinge pin receptacle.

7. A gate device in combination with an opening defined by opposing first and second vertical surfaces, said gate device comprising:

(a) a hinge member attached to said first vertical surface, (b) an adjustable, telescoping gate panel member comprising a first panel member pivotally mounted to said hinge member and positioned at least partially inside a second panel member slidably mounted on said first panel; and (c) a latch secured to said second vertical surface, said latch comprising a receiving member and a compressible insertion member, wherein the latch is operated by compressing the insertion member and moving the second panel member a distance sufficient to disengage or engage the insertion member and the receiving member.

8. A gate device as claimed in claim 7 wherein said second panel member comprises a front panel and a rear panel positioned opposite each other and forming a cavity wherein said first panel member is located, and at least one of said front and rear panels is at least partially in a shape selected from the group consisting of a cartoon character and an animal.

9. A gate device as claimed in claim 8 wherein said second panel member is at least partially in said shape and wherein said shape is 3-dimensional.

10. A gate device as claimed in claim 7 wherein said hinge member comprises a mounting plate on which a hinge pin receptacle is mounted, said hinge pin receptacle comprising a cavity, and a continuous slot opposite said mounting plate.

11. A gate device as claimed in claim 10 wherein said first panel comprises a hinge pin for pivotal mounting within said hinge pin receptacle.

12. A gate device as claimed in claim 11 wherein said continuous slot limits pivotal movement of the gate panel member.

13. A gate device as claimed in claim 12 wherein said continuous slot limits the pivotal movement of the gate panel member to an equal distance on opposite sides of the opening.

14. A gate device as claimed in claim 7 wherein said insertion member is compressed on opposite sides, relative to a substantially central and substantially vertical plane, to be engaged with or disengaged from said receiving member.

15. A gate device as claimed in claim 7 wherein said insertion member comprises a compression portion connected to an insertion portion.

16. A gate device for use in a door opening defined by opposing first and second vertical surfaces wherein a door is pivotally attached to the first vertical surface, said gate device comprising:

(a) a C-shaped hinge member for attachment to said first vertical surface, wherein the hinge member does not prevent substantial pivotal movement of said door, (b) a gate panel member pivotally mounted to said hinge; and (c) a latch for securing said gate panel member to said second vertical surface wherein said latch is C-shaped and is adjustable for attachment to a second vertical surface having various dimensions.

17. A gate device as claimed in claim 16 wherein said hinge member is adjustable for attachment to a first vertical surface having various dimensions.

18. A gate device as claimed in claim 16 wherein said gate panel is at least partially in a shape selected from the group consisting of a cartoon character and an animal.

19. A gate device for use in a door opening defined by opposing first and second vertical surfaces wherein a door is pivotally attached to the first vertical surface, said gate device comprising:

a) a C-shaped hinge member for attachment to said first vertical surface, wherein the hinge member does not prevent substantial pivotal movement of said door, (b) a gate panel member pivotally mounted to said hinge; and (c) a latch for securing said gate panel member to said second vertical surface, wherein said hinge member and said latch comprise tensioning knobs only on one side thereof.

* * * * *